US011536261B2

(12) United States Patent
Mou et al.

(10) Patent No.: US 11,536,261 B2
(45) Date of Patent: Dec. 27, 2022

(54) MICRO PUMP

(71) Applicant: Microjet Technology Co., Ltd., Hsinchu (TW)

(72) Inventors: Hao-Jan Mou, Hsinchu (TW); Shih-Chang Chen, Hsinchu (TW); Jia-Yu Liao, Hsinchu (TW); Hung-Hsin Liao, Hsinchu (TW); Chung-Wei Kao, Hsinchu (TW); Yung-Lung Han, Hsinchu (TW); Chi-Feng Huang, Hsinchu (TW); Chun-Yi Kuo, Hsinchu (TW)

(73) Assignee: MICROJET TECHNOLOGY CO., LTD., Hsinchu (TW)

( * ) Notice: Subject to any disclaimer, the term of this patent is extended or adjusted under 35 U.S.C. 154(b) by 434 days.

(21) Appl. No.: 16/919,608

(22) Filed: Jul. 2, 2020

(65) Prior Publication Data

US 2021/0048012 A1 Feb. 18, 2021

(30) Foreign Application Priority Data

Aug. 14, 2019 (TW) ..... 108129016

(51) Int. Cl.
*F04B 43/04* (2006.01)
*F04B 19/00* (2006.01)

(52) U.S. Cl.
CPC ..... *F04B 43/046* (2013.01); *F04B 19/006* (2013.01)

(58) Field of Classification Search
CPC ..... F04B 17/003; F04B 19/006; F04B 35/04; G06F 1/20; G06F 1/206; H05K 7/20136
See application file for complete search history.

(56) References Cited

U.S. PATENT DOCUMENTS 10,047,870 B2 * 8/2018 Wu ..... F16K 7/12
10,199,306 B2 * 2/2019 Chen ..... G06F 1/206
10,698,451 B2 * 6/2020 Mou ..... F04B 45/047
(Continued)

FOREIGN PATENT DOCUMENTS

CN 102679010 A 9/2012
CN 104234986 A 12/2014
CN 205918569 U 2/2017
(Continued)

*Primary Examiner* — Nathan C Zollinger

(74) *Attorney, Agent, or Firm* — Birch, Stewart, Kolasch & Birch, LLP

(57) ABSTRACT

A micro pump includes a base plate, a valve membrane, an upper covering plate and a pump core module. The valve membrane is disposed in a valve membrane accommodation slot of the base plate, seals a fluid channel of the base plate and includes a valve aperture where a protruding portion of the base plate extended through. The upper covering plate is accommodated in an upper covering plate accommodation slot of the base plate and includes a fluid relief aperture sealed by the valve membrane, a fluid converging groove and a fluid converging channel between the fluid converging groove and a fluid-outlet channel of the base plate. The pump core module is accommodated within a pump accommodation slot of the base plate. By actuating the pump core module, the fluid passes through the fluid channel, the valve aperture, the fluid converging groove, and is discharged out through the fluid-outlet channel.

16 Claims, 19 Drawing Sheets

(56) References Cited

U.S. PATENT DOCUMENTS

| | | | | |
|---|---|---|---|---|
| 2018/0146573 | A1* | 5/2018 | Chen | H05K 7/20209 |
| 2018/0240733 | A1* | 8/2018 | Chen | H05K 7/20127 |

FOREIGN PATENT DOCUMENTS

| | | | |
|---|---|---|---|
| CN | 107023466 | A | 8/2017 |
| EP | 1548284 | A2 | 6/2005 |
| JP | 2009-41501 | A | 2/2009 |
| JP | 2019-39426 | A | 3/2019 |
| TW | 201610298 | A | 3/2016 |
| TW | 201825778 | A | 7/2018 |
| WO | WO 2019/123819 | A1 | 6/2019 |

* cited by examiner

MICRO PUMP

FIELD OF THE INVENTION

The present disclosure relates to a pump, and more particularly to a micro pump which is miniature, silent and able to transport fluid at high flow rapidly.

BACKGROUND OF THE INVENTION

Currently, products used in in various fields, such as pharmaceutical industries, computer techniques, printing industries or energy industries, are developed in the trend of elaboration and miniaturization. The fluid transportation devices, as the result, become important components used in, for example, micro pumps, micro atomizers, printheads or the industrial printers.

With the rapid advancement of science and technology, the application of fluid transportation device become be more and more diversified and the fluid transportation device are utilized in various industrial applications, such as the biomedical applications, the healthcare, the electronic cooling, even the most popular wearable devices and so on. As the result, the conventional fluid transportation devices gradually tend to miniaturize the structure and maximize the flow rate thereof.

Therefore, how to increase the versatility of a fluid actuating device by utilizing an innovative packaging structure, has become a main subject of research and an important part of development.

SUMMARY OF THE INVENTION

The object of the present disclosure is to provide a micro pump. By embedding an upper covering plate to a base plate with a valve membrane clamped therebetween, a semi-staggered valve base structure provided with unidirectional output and pressure relief function is formed in the micro pump, so as to achieve the benefits of greatly simplifying the structure of the valve membrane, enhancing the overall reliability of airtightness, optimizing the thin profile of the overall outer case, and greatly reducing the flow resistance of pressure relief.

In accordance with an aspect of the present disclosure, a micro pump includes a base plate, a valve membrane, an upper covering plate and a pump core module is provided. The base plate has a first surface and a second surface, and the first surface and the second surface are two opposite surfaces. The base plate includes an upper covering plate accommodation slot, a valve membrane accommodation slot, a protruding portion, a pump accommodation slot, a fluid channel and a fluid-outlet channel, wherein the upper covering plate accommodation slot is recessed from the first surface of the base plate and has a bottom surface; the valve membrane accommodation slot is recessed from the bottom surface of the upper covering plate accommodation slot and has a bottom surface; the protruding portion is protruded from the bottom surface of the upper covering plate accommodation slot; the pump accommodation slot is recessed from the second surface of the base plate and has a bottom surface; and the fluid channel runs through the bottom surface of the valve membrane accommodation slot and the bottom surface of the pump accommodation groove. The valve membrane is disposed in the valve membrane accommodation slot of the base plate and includes a valve aperture. The protruding portion of the base plate is extended through the valve aperture and seals the valve aperture. The fluid channel of the base plate is covered and sealed by the valve membrane. The upper covering plate is accommodated in the upper covering plate accommodation slot of the base plate and includes a fluid relief aperture, a fluid converging groove and a fluid converging channel. The fluid relief aperture is also sealed by the valve membrane. The fluid converging groove is in fluid communication with the fluid-outlet channel of the base plate through the fluid converging channel. The pump core module is accommodated within the pump accommodation slot of the base plate. After fluid is inhaled by the pump core module and flows into the pump core module, the fluid passes through the fluid channel of the base plate, pushes out the valve membrane, flows through the valve aperture of the valve membrane, enters the fluid converging groove of the upper covering plate, and is discharged out through the fluid-outlet channel of the base plate, so as to achieve fluid transportation.

The above contents of the present disclosure will become more readily apparent to those ordinarily skilled in the art after reviewing the following detailed description and accompanying drawings, in which:

DETAILED DESCRIPTION OF THE PREFERRED EMBODIMENT

Figure 1A:
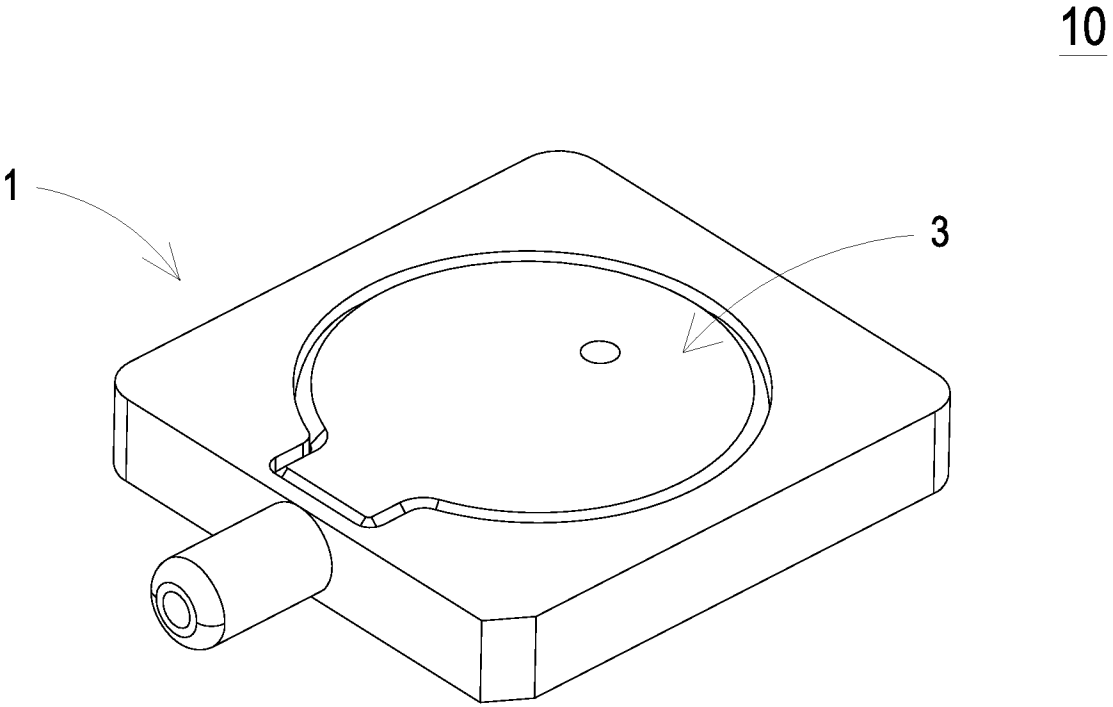
FIG. 1A is a schematic perspective view illustrating a micro pump of the present disclosure.
Figure 1B:
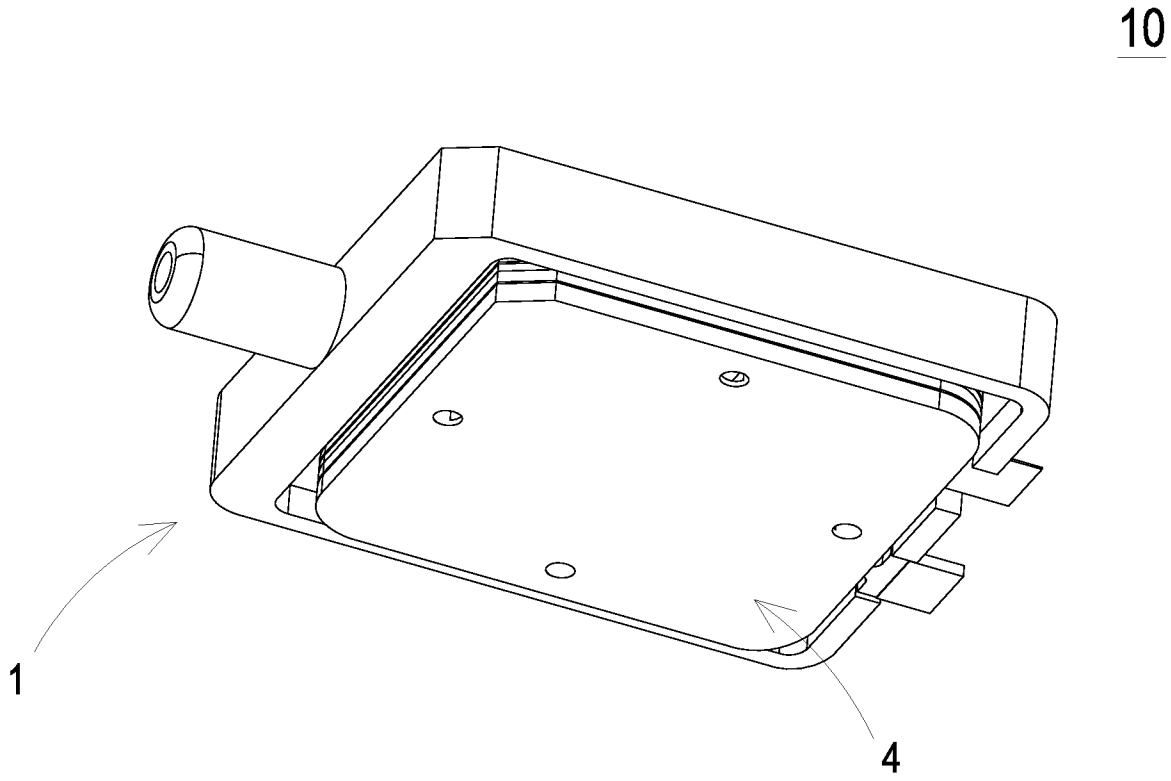
FIG. 1B is a schematic perspective view illustrating a micro pump of FIG. 1A with different viewing angle.
Figure 2A:
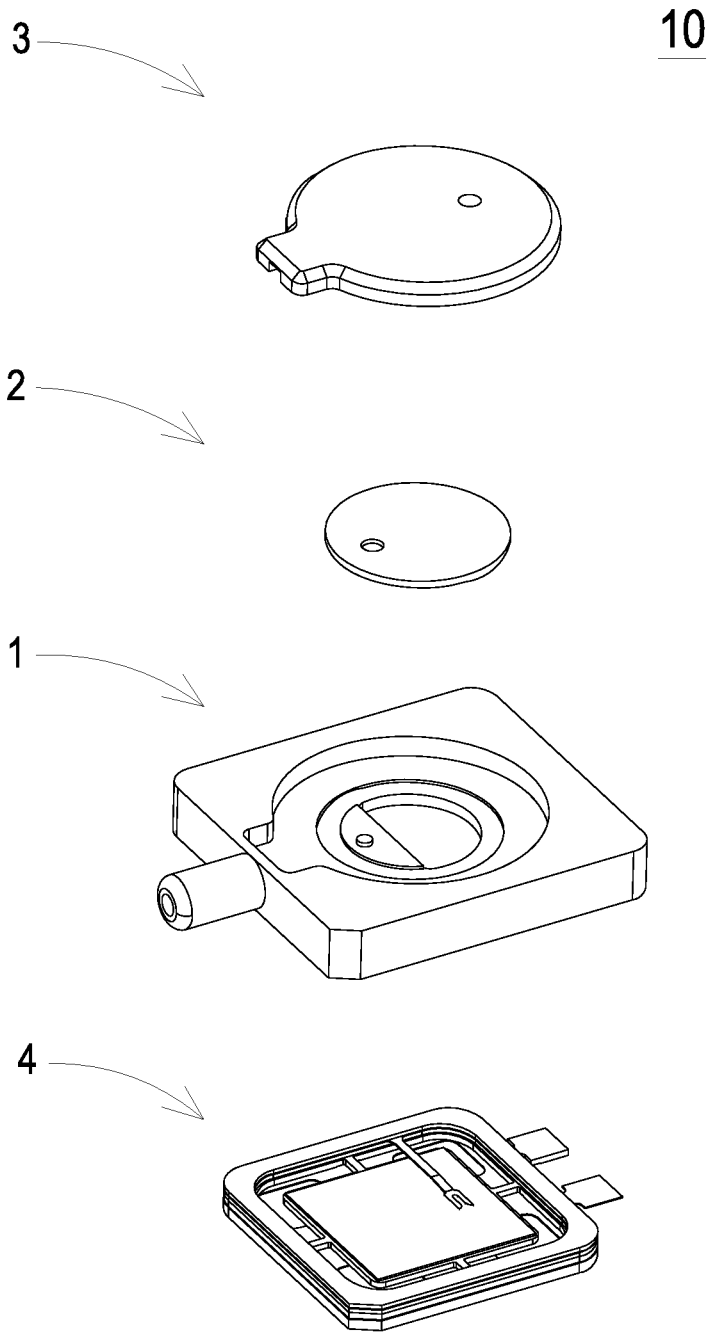
FIG. 2A is a schematic exploded perspective view illustrating the micro pump of the present disclosure.
Figure 2B:
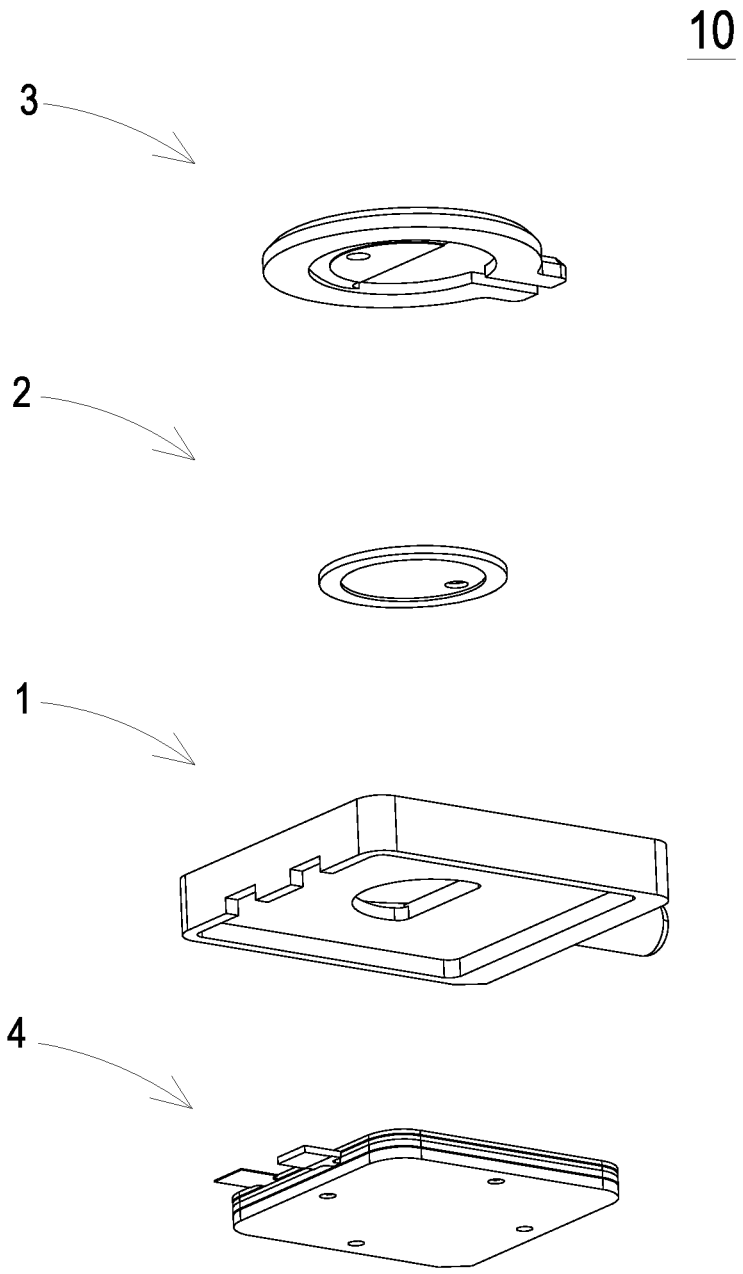
FIG. 2B is a schematic exploded perspective view illustrating the micro pump of FIG. 2A with different viewing.

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Please refer to FIGS. 1A to 1B and FIGS. 2A to 2B. The present disclosure provides a micro pump 10 including a base plate 1, a valve membrane 2, an upper covering plate 3 and a pump core module 4. The pump core module 4 is accommodated within the base plate 1 on one side thereof, and the base plate 1 is covered and sealed by the upper covering plate 3 on the other side with the valve membrane 2 sandwiched therebetween for forming the micro pump 10.

Figure 3B:
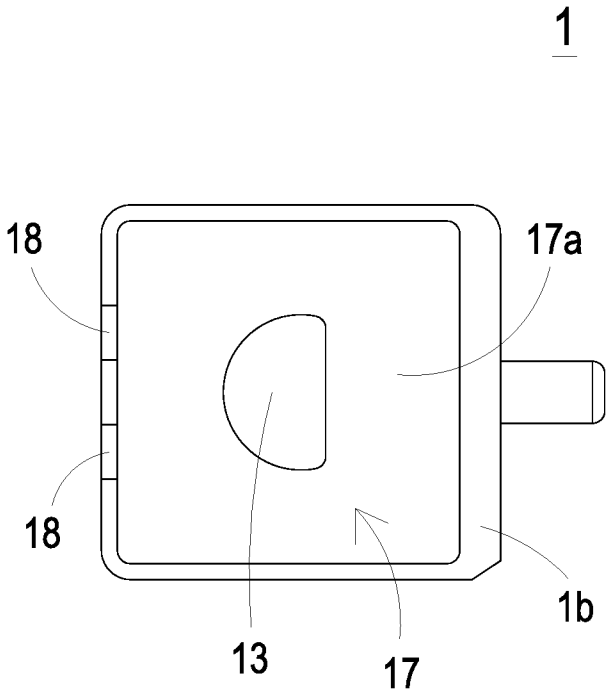
FIGS. 3A and 3B are a top view and a bottom view of the base plate of the micro pump of the present disclosure, respectively.
Figure 3A:
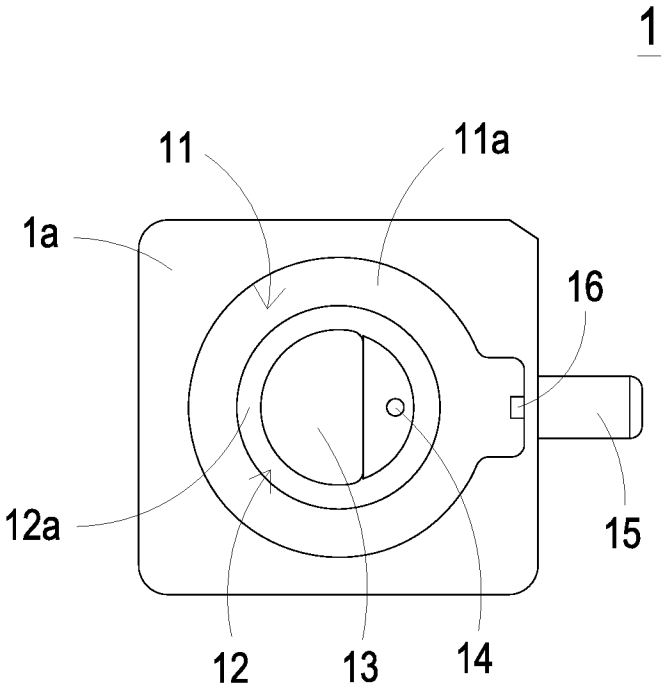
Figure 4B:
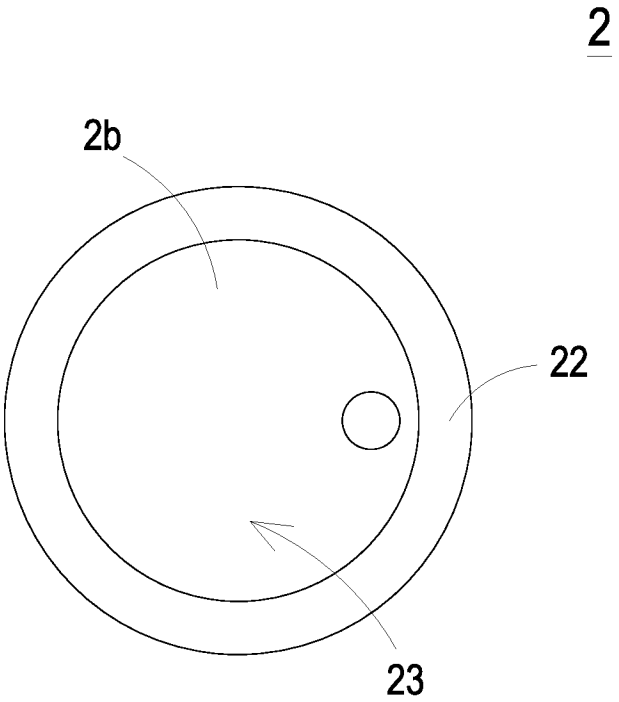
FIGS. 4A and 4B are a top view and a bottom view of the valve membrane of the micro pump of the present disclosure, respectively.
Figure 4A:
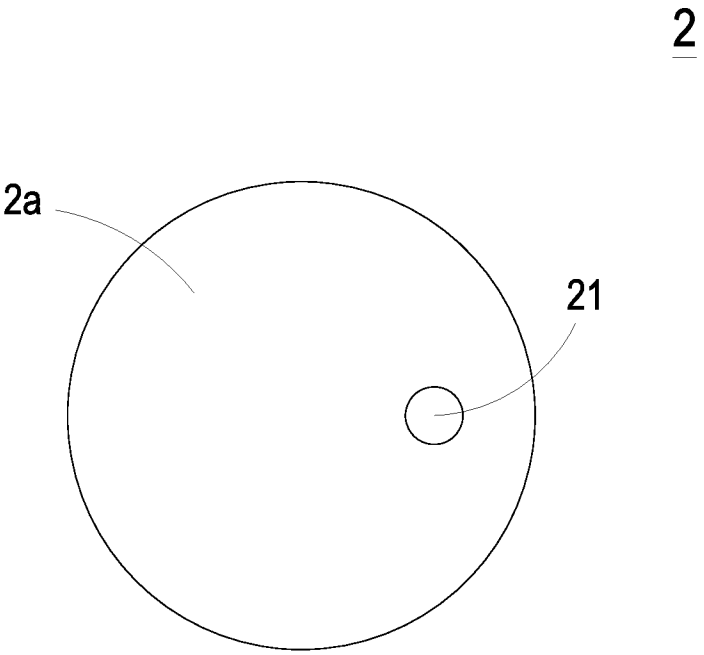
Figure 5B:
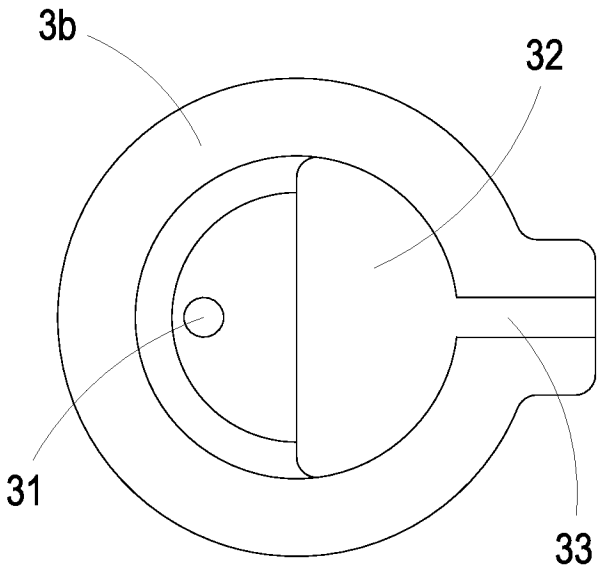
FIGS. 5A and 5B are a top view and a bottom view of the upper covering plate of the micro pump of the present disclosure, respectively.
Figure 5A:
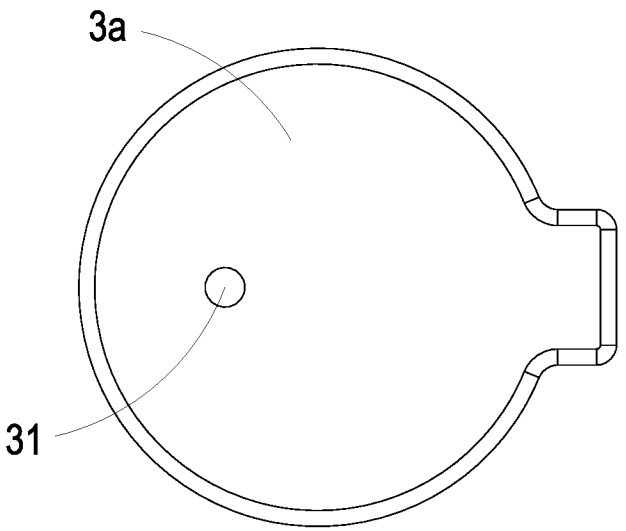
Figure 6A:
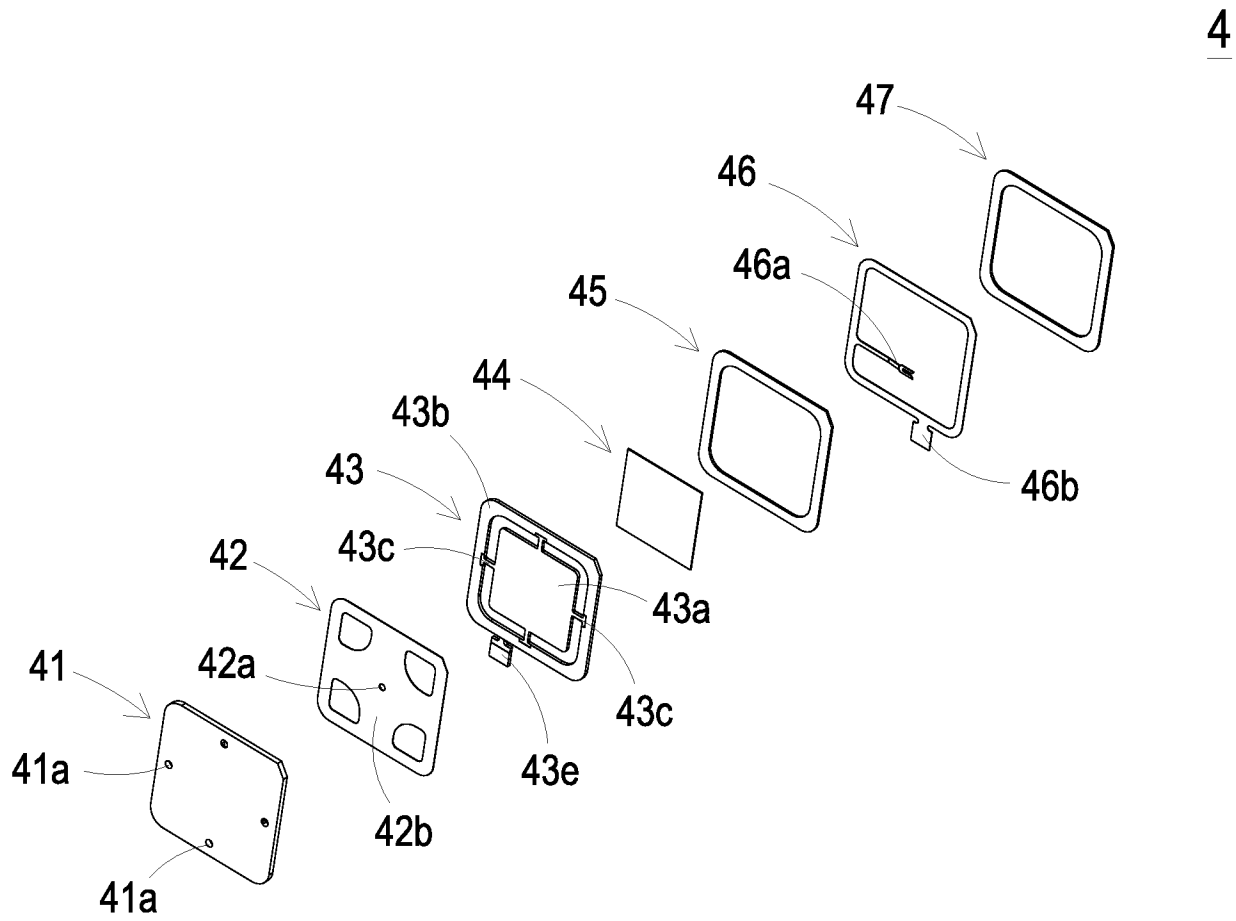
FIG. 6A is a schematic exploded perspective view illustrating the pump core module of the micro pump of the present disclosure.
Figure 6B:
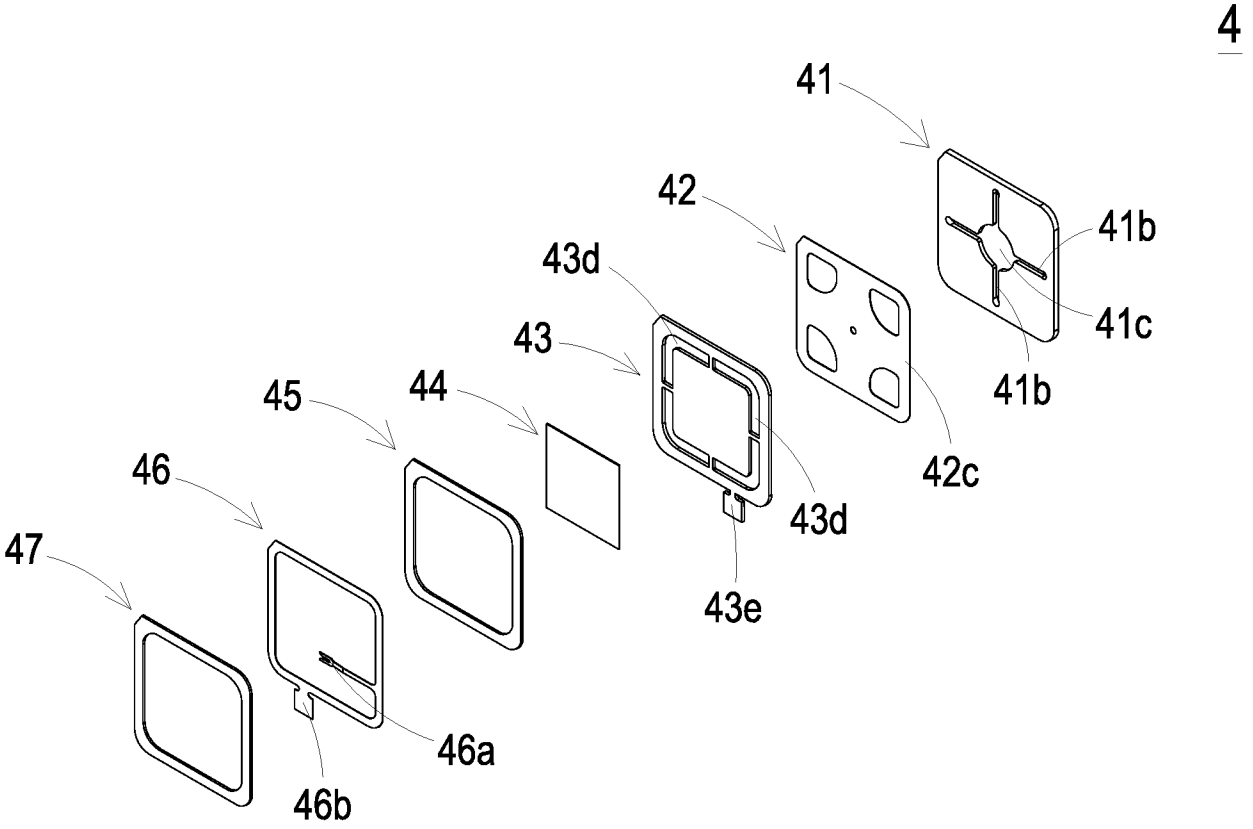
FIG. 6B is a schematic exploded perspective view illustrating the pump core module of the micro pump of FIG. 6A with different viewing.

Please refer to FIGS. 3A and 3B for the structure of the base plate 1. In this embodiment, the base plate 1 has a first surface 1*a* and a second surface 1*b* opposite to each other. In this embodiment, the base plate 1 includes an upper covering plate accommodation slot 11, a valve membrane accommodation slot 12, a fluid channel 13, a protruding portion 14, a fluid-output tube 15, a fluid-outlet channel 16, a pump accommodation slot 17 and a plurality of pin openings 18. The upper covering plate accommodation slot 11 is recessed from the first surface 1*a* of the base plate 1 and has a bottom surface 11*a*. The valve membrane accommodation slot 12 is recessed from the bottom surface 11*a* and has a bottom surface 12*a*. The protruding portion 14 is protruded from the bottom surface 11*a* of the upper covering plate accommodation slot 11. In this embodiment, the protruding portion 14 is a cylindrical structure, but not limited thereto. The fluid-output tube 15 is extended outwardly from a side of the base plate 1 and is penetrated by the fluid-outlet channel 16. The pump accommodation slot 17 is recessed from the second surface 1*b* of the base plate 1 and has a bottom surface 17*a*. The fluid channel 13 runs through the bottom surface 12*a* of the valve membrane accommodation slot 12 and the bottom surface 17*a* of the pump accommodation groove 17 such that the upper covering plate accommodation slot 11 are in fluid communication with the pump accommodation groove 17. In this embodiment, the fluid channel 13 has a sector profile within the valve membrane accommodation slot 12 to increase the flow quantity of the fluid, but not limited thereto, and the protruding portion 14 is placed within the valve membrane accommodation slot 12 outside of the sector profile. In other embodiments, the profile of the fluid channel 13 is adjustable according to the design requirements. The pin openings 18 are in fluid communication with the pump accommodation slot 17.

Please refer to FIGS. 2A, 2B, 3A, 3B, 4A and 4B. In this embodiment, the valve membrane 2 is accommodated in the valve membrane accommodation slot 12 and has a first surface 2*a* and a second surface 2*b*. The valve membrane 2 includes a valve aperture 21 and a valve peripheral wall 22. The valve peripheral wall 22 is disposed on the second surface 2*b* and defines a valve space 23. The valve aperture 21 runs through the first surface 2*a* and the second surface 2*b*. The protruding portion 14 of the base plate 1 is extended through and sealed the valve aperture 21 of the valve membrane 2, and the fluid channel 13 of the base plate 1 is covered and thereby sealed by the valve membrane 2 when they are assembled. In a further embodiment, the sector profile of fluid channel 13 is corresponded to and in fluid communication with the valve space 23.

Notably, in this embodiment, the valve membrane 2 is in a circular shape, but not limited thereto. In other embodiments, the shape of the valve membrane 2 is adjustable according to the design requirements.

Notably, in this embodiment, the valve membrane 2 is a silicone sheet, but not limited thereto. In other embodiments, the material of the valve membrane 2 is adjustable according to the design requirements.

Please refer to FIGS. 2A, 2B, 3A, 3B, 5A and 5B. In this embodiment, the upper covering plate 3 is accommodated in the upper covering plate accommodation slot 11 of the base plate 1 and has a first surface 3*a* and a second surface 3*b*. The upper covering plate 3 includes a fluid relief aperture 31, a fluid converging groove 32 and a fluid converging channel 33. The fluid relief aperture 31 runs through the first surface 3*a* and the second surface 3*b* and is sealed by the valve membrane 2 when they are assembled. The fluid converging groove 32 and the fluid converging channel 33 are recessed from the second surface 3*b*. The fluid converging groove 32 is in fluid communication with the fluid-outlet channel 16 of the base plate 1 through the fluid converging channel 33.

Notably, in this embodiment, the fluid converging groove 32 has a sector profile used to increase the flow quantity of the fluid, but not limited thereto. In other embodiments, the profile of the fluid converging groove 32 is adjustable according to the design requirements. In this embodiment, the fluid converging groove 32 and the fluid channel 13 of the base plate 1 are staggered with each other in position, but not limited thereto. In other embodiments, the disposed position of the fluid converging groove 32 is adjustable according to the design requirements. In another embodiment, the protruding portion 14 of the base plate 1 is within the sector profile area of the fluid converging groove 32.

Notably, in this embodiment, the fluid relief aperture 31 has an aperture diameter ranging between 0.5 millimeter (mm) and 2 millimeter (mm) and is staggered with the protruding portion 14 of the base plate 1, but not limited thereto. In other embodiments, the aperture diameter size and the position of the fluid relief aperture 31 are adjustable according to the design requirements.

Please refer to FIGS. 1A, 1B, 2A, 2B, 6A and 6B. In this embodiment, the pump core module 4 is accommodated within the pump accommodation slot 17 of the base plate 1. In this embodiment, the pump core module 4 includes a fluid-inlet plate 41, a resonance plate 42, a piezoelectric actuator 43, a first insulation plate 45, a conducting plate 46 and a second insulation plate 47, which are stacked sequentially. The fluid-inlet plate 41 includes at least one inlet aperture 41*a*, at least one convergence channel 41*b* and a convergence chamber 41*c*. The at least one inlet aperture 41*a* allows the fluid to flow in and passes through the at least one convergence channel 41*b*. The at least one convergence channel 41*b* and the convergence chamber 41*c* are in fluid communication. Thus, the liquid inhaled through the at least inlet aperture 41*a* is transported through the at least one convergence channel 41*b* and converged into the convergence chamber 41*c*. In this embodiment, the number of the inlet apertures 41*a* and the number of the convergence channels 41*b* are equal to four, respectively, but are not limited thereto. The numbers of the inlet apertures 41*a* and the convergence channels 41*b* are adjustable according to the practical requirements. In this embodiment, the four inlet apertures 41*a* pass through the four convergence channels 41*b*, respectively, and the four convergence channels 41*b* are in fluid communication with the convergence chamber 41*c*.

In this embodiment, the resonance plate 42 is connected and attached to the fluid-inlet plate 41, and includes a central aperture 42*a*, a movable portion 42*b* and a fixing part 42*c*. The central aperture 42*a* is disposed at a center of the resonance plate 42 and aligned with the convergence chamber 41*c* of the fluid-inlet plate 41. The movable part 42*b* surrounds the central aperture 42*c*. The fixing part 42*c* is located at a peripheral portion of the resonance plate 42 and is fixed on and attached to the fluid-inlet plate 41.

In this embodiment, the piezoelectric actuator 43 is connected and attached to the resonance plate 42, and includes a suspension plate 43*a*, an outer frame 43*b*, at least one bracket 43*c*, a piezoelectric element 44, at least one vacant space 43*d* and a first conductive pin 43*e*. The suspension plate 43*a* is a square suspension plate, and permitted to undergo a bending vibration. That is, the suspension plate 43*a* is capable of being bent and may be permitted to undergo vibration. In this embodiment, the suspension plate 43*a* adopts a square shape. Compared to the design of the circular shape, the structure of the suspension plate 43*a* in the square shape has an obvious advantage of power saving. The power consumption of a capacitive load operated at a resonance frequency is increased as the frequency is raised, and the frequency of the suspension plate 43*a* in the square shape is significantly lower than that of the suspension plate in the circular shape. Therefore, the power consumption of the suspension plate 43*a* in the square shape is significantly lower than that of the suspension plate in the circuit shape. Namely, the suspension plate 43*a* of the present disclosure may be designed in a square shape and has the advantage of power saving. In this embodiment, the outer frame 43*b* is arranged around the suspension plate 43*a*, and at least one bracket 43*c* is connected between the suspension plate 43*a* and the outer frame 43*b* for elastically supporting the suspension plate 43*a*. In this embodiment, a length of a side of the piezoelectric element 44 is smaller than or equal to a length of a side of the suspension plate 43*a*, and the piezoelectric element 44 is attached on a surface of the suspension plate 43*a* to drive the suspension plate 43*a* to undergo the bending vibration in response to an applied voltage. The at least one vacant space 43*d* is formed among the suspension plate 43*a*, the outer frame 43*b* and the bracket 43*c* for allowing the fluid to flow through. The first conductive pin 43*e* is extended outwardly from an outer edge of the outer frame 43*b*.

In this embodiment, the conducting plate 46 includes an electrode 46*a* protruded from an inner edge thereof and in curved shape, and a second conductive pin 46*b* protruded from an outer edge thereof. The electrode 46*a* is electrically connected to the piezoelectric element 44 of the piezoelectric actuator 43. The first conducting pin 43*e* of the piezoelectric actuator 43 and the second conductive pin 46*b* of the conducting plate 46 are externally connected to an external current, thereby driving the piezoelectric element 44 of the piezoelectric actuator 43. The first conducting pin 43*e* and the second conductive pin 46*b* are extended outside the base plate 1 through the plurality of pin openings 18, respectively. In addition, with the arrangement of the first insulation plate 45 and the second insulation plate 47, the occurrence of short circuit is avoided.

Please return to FIGS. 1A and 1B. Notably, in this embodiment, the upper covering plate 3 and the base plate 1 are connected and attached to each other by gluing, thereby forming the micro pump 10 of the present disclosure. In other embodiments, the connection method of the upper covering plate 3 and the base plate 1 is adjustable according to the design requirements. The present disclosure is not limited thereto. In this embodiment, the micro pump 10 has a total thickness ranging between 1 millimeter (mm) and 6 millimeter (mm), but not limited thereto. In other embodiments, the value of the total thickness of the micro pump 10 is adjustable according to the design requirements.

Figure 7A:
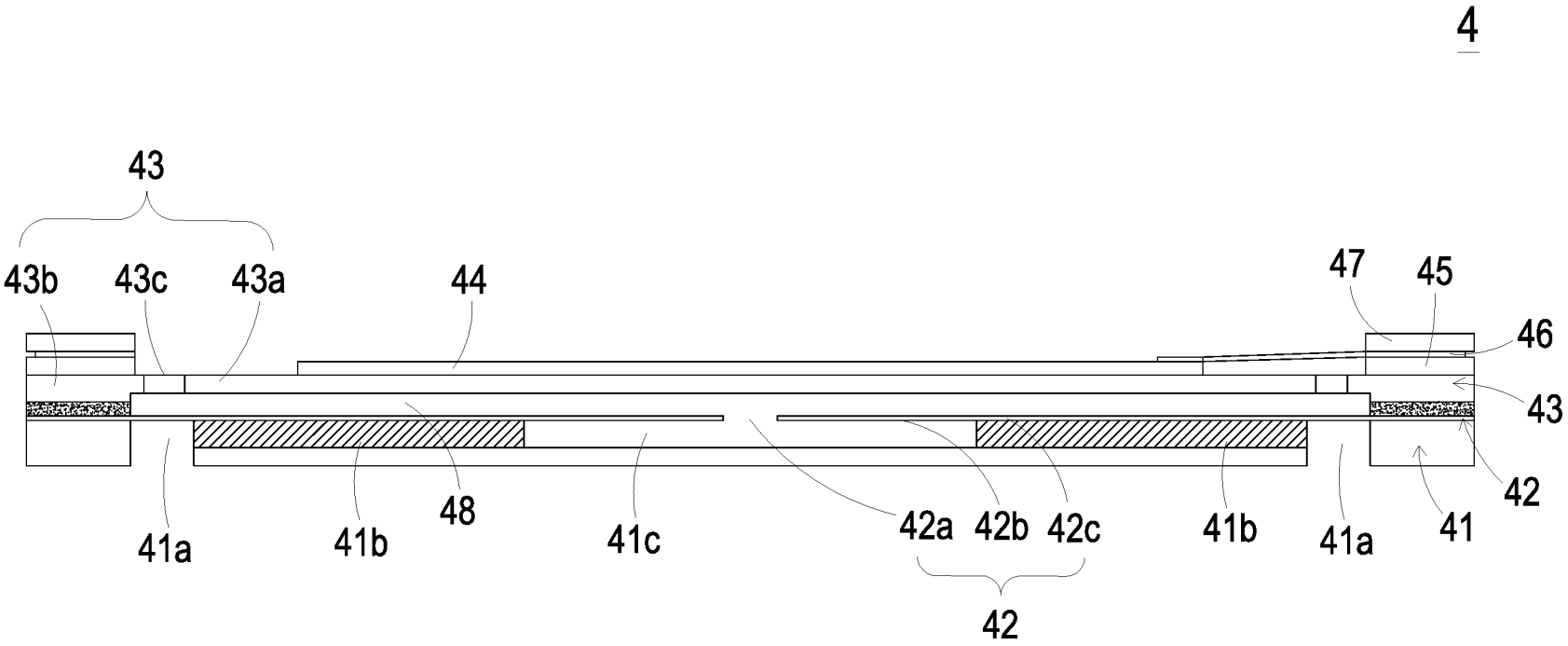
FIG. 7A is a schematic cross-sectional view illustrating an exemplary structure of the pump core module.
Figure 7B:
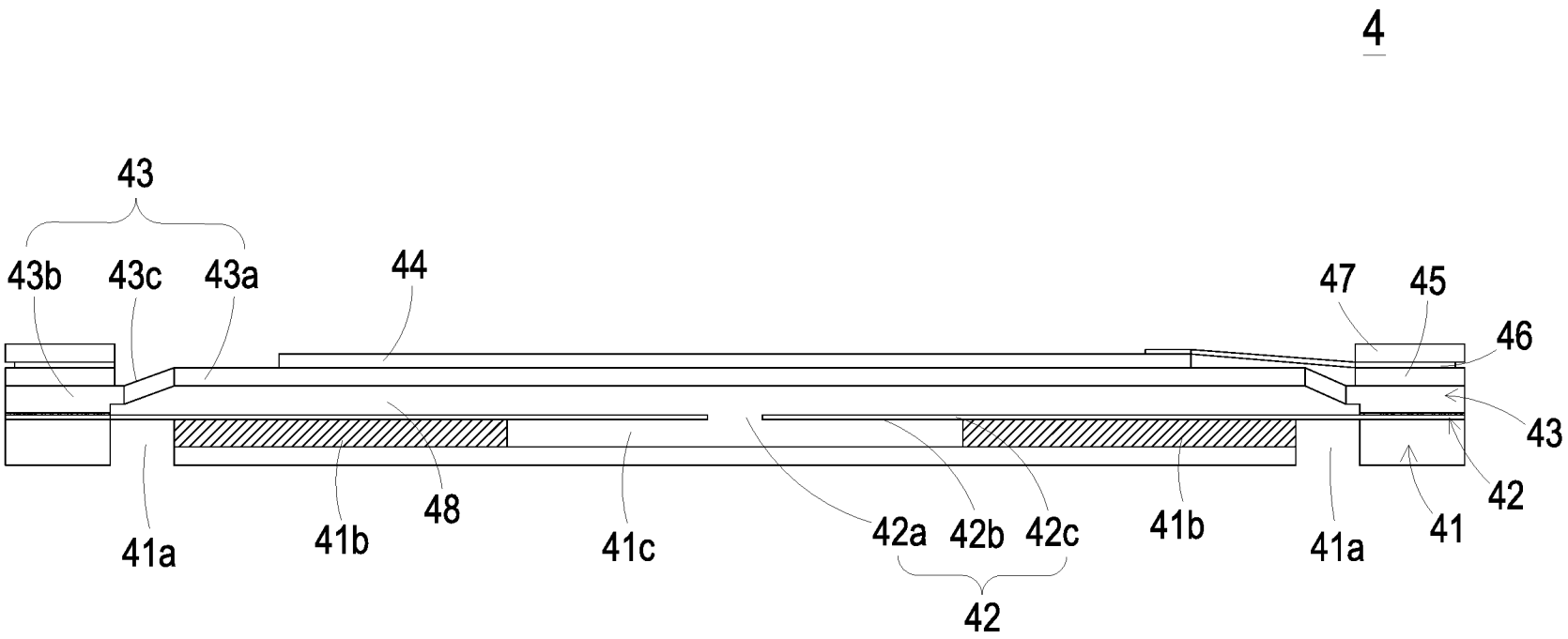
FIG. 7B is a schematic cross-sectional view illustrating another exemplary structure of the pump core module.

Please refer to FIG. 7A. In this embodiment, a resonance chamber 48 is formed between the suspension plate 43*a* and the resonance plate 42. The resonance chamber 48 is formed by filling a material, for example but not limited to a conductive adhesive, into a gap between the resonance plate 42 and the outer frame 43*b* of the piezoelectric actuator 43. Thus, a depth from the resonance plate 42 to the suspension plate 43*a* of the piezoelectric actuator 43 can be maintained, and the fluid can be transported rapidly. In addition, since the proper distance between the suspension plate 43*a* and the resonance plate 42 is maintained, the contact interference is reduced and the noise generated is largely reduced. In some embodiments, alternatively, the height of the outer frame 43*b* of the piezoelectric actuator 43 can be increased, so as to reduce the thickness of the conductive adhesive filled within the gap between the resonance plate 42 and the outer frame 43*b* of the piezoelectric actuator 43. Therefore, the conductive adhesive is not affected by the hot-pressing temperature and cooling temperature as the pump core module 4 is assembled, and the actual distance of resonance chamber 48 is not affected by the thermal expansion and contraction phenomenon occur in the assembling process. The present disclosure is not limited thereto. In addition, the transportation efficiency of the pump core module 4 is affected by the size of resonance chamber 48, so that it is important for the resonance chamber 48 to be maintained in a fixed size to provide stable transportation efficiency of the pump core module 4. Please refer to FIG. 7B. In another exemplary structure of the pump core module 4, the suspension plate 43*a* can be formed by a stamping process. The stamping process makes the suspension plate 43*a* extended upwardly at a distance, and the distance extended may be adjusted by the bracket 43*c* formed between the suspension plate 43*a* and the outer frame 43*b*, so that a surface of the suspension plate 43*a* and a surface of the outer frame 43*b* collaboratively form a non-coplanar structure. A small amount of a filling material, for example a conductive adhesive, is applied to the assembly surface of the outer frame 43*b*, so as to attach the piezoelectric actuator 43 on the fixing part 42*c* of the resonance plate 42 by means of hot-pressing process, so that the piezoelectric actuator 43 is assembled with the resonance plate 42. In this way, the entire structure may be improved by forming the suspension plate 43*a* of the piezoelectric actuator 43 with stamping process, thereby, the resonance chamber 48 can also be modified. The desired resonance chamber 48 may be achieved simply by adjusting the stamping distance for the suspension plate 43*a* of piezoelectric actuator 43. The structural design for adjusting the resonance chamber 48 and manufacture process can therefore be simplified, and saving manufacturing time. In this embodiment, the first insulation plate 45, the conducting plate 46 and the second insulation plate 47 are all frame-shaped thin sheet, and are stacked sequentially on the piezoelectric actuator 43 to obtain the complete structure of the pump core module 4.

Figure 7C:
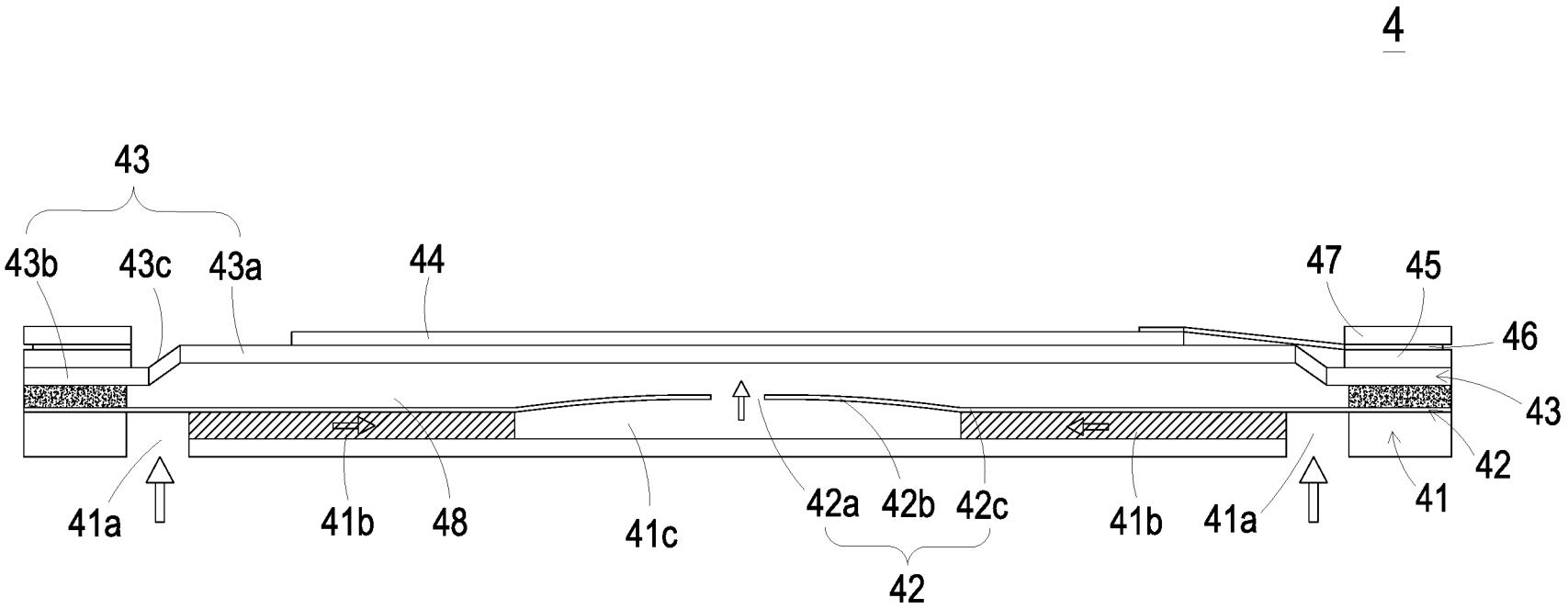
FIGS. 7C to 7E are cross sectional views illustrating actions of the pump core module of the present disclosure.
Figure 7D:
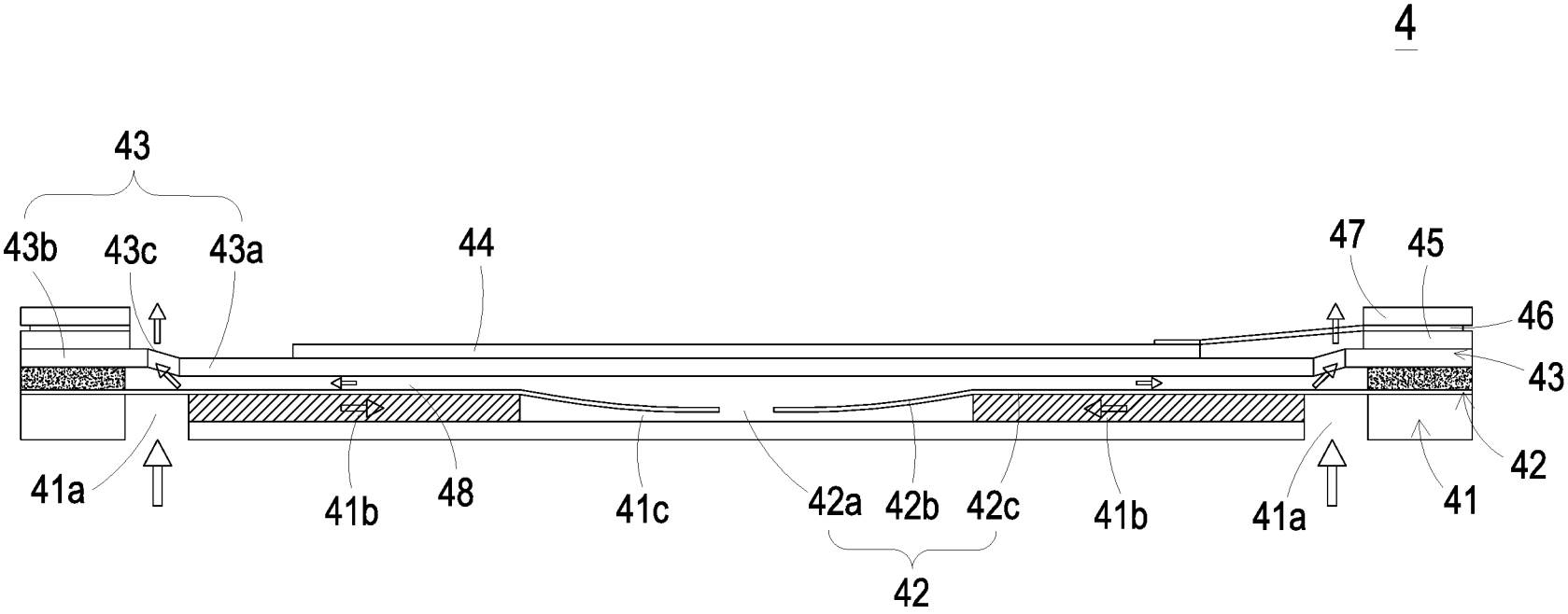
Figure 7E:
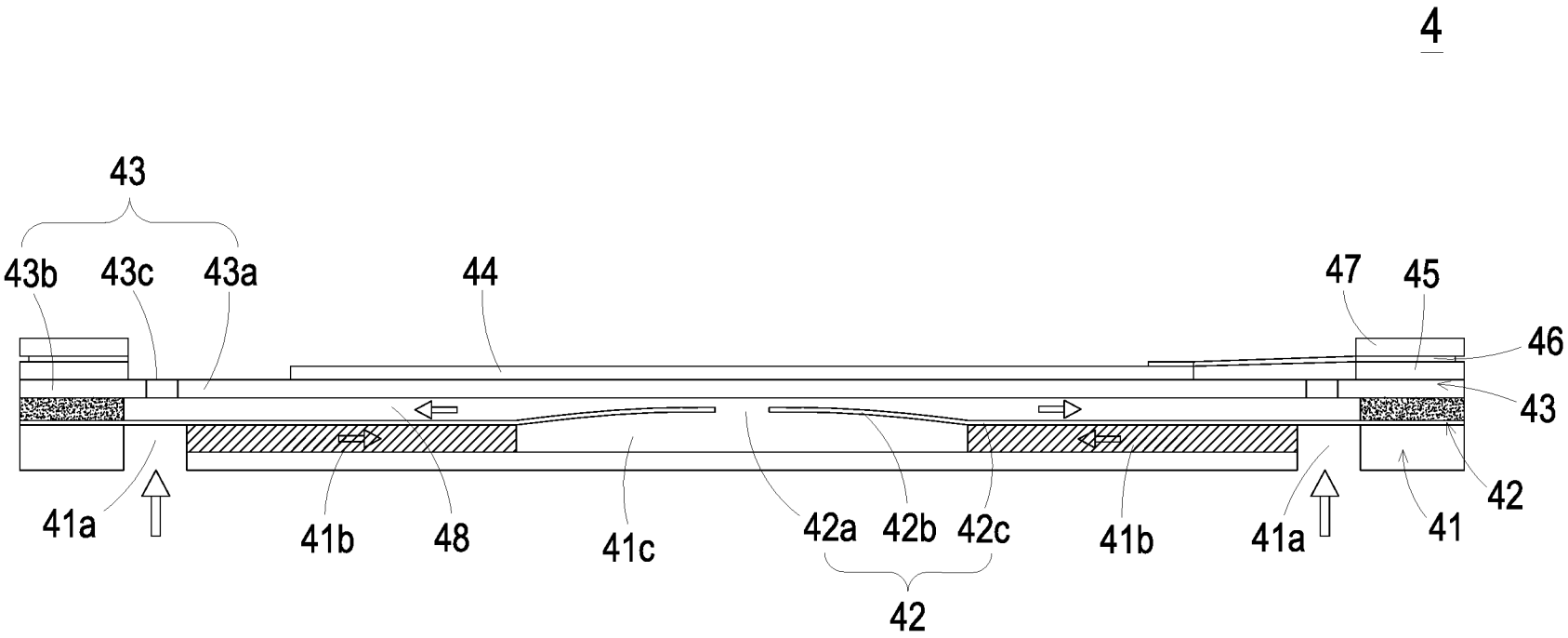

For the actions of the pump core module 4, please refer to FIGS. 7C to 7E. Firstly, as shown in FIG. 7C, when the piezoelectric element 44 of the piezoelectric actuator 43 is deformed in response to an applied voltage, the suspension plate 43*a* is displaced in a direction away from the fluid-inlet plate 41. Since the volume of the resonance chamber 48 is increased as the suspension plate 43*a* displaced, a negative pressure is formed in the resonance chamber 48, and the fluid in the convergence chamber 41*c* is inhaled, passes through the central aperture 42*a* of the resonance plate 42 and enters the resonance chamber 48. At the same time, the resonance plate 42 is in resonance and thus displaced synchronously in the direction away from the fluid-inlet plate 41. Thereby, the volume of the convergence chamber 41*c* is increased. Since the fluid in the convergence chamber 41*c* flows into the resonance chamber 48, the convergence chamber 41*c* is also in a negative pressure state, and the fluid is inhaled into the convergence chamber 41*c* by flowing through the inlet apertures 41*a* and the convergence channels 41*b*. Next, as shown in FIG. 7D, the piezoelectric element 44 drives the suspension plate 43*a* to be displaced toward the fluid-inlet plate 41 to compress the resonance chamber 48. Similarly, the resonance plate 42 is in resonance with the suspension plate 43*a* and is displaced toward the fluid-inlet plate 41. As a result, the fluid in the resonance chamber 48 is compressed synchronously and forced to be further transported through the vacant space 43*d* and discharged out of the pump core module 4, and achieve the effect of fluid transportation. Finally, as shown in FIG. 7E, when the suspension plate 43*a* vibrates in the direction away from the fluid-inlet plate 41 and back to the initial position, the resonance plate 42 is also driven to displace in the direction away from the fluid-inlet plate 41 at the same time. Meanwhile, the resonance plate 42 pushes the fluid in the resonance chamber 48 toward the vacant space 43*d*, and the volume of the convergence chamber 41*c* is increased. Thus, the fluid can continuously flow through the inlet apertures 41*a* and the convergence channels 41*b* and be converged in the convergence chamber 41*c*. By repeating the actions of the pump core module 4 shown in the above-mentioned FIGS. 7C to 7E continuously, the pump core module 4 can continuously transport the fluid. The fluid is inhaled through the inlet aperture 41*a* and enters the flow channel formed by the fluid-inlet plate 41 and the resonance plate 42. A pressure gradient is generated in the flow channel, and then the fluid is discharged through the vacant space 43*d*. Thus, the fluid is transported at a high speed to accomplish the fluid transportation and output operations of the pump core module 4.

Figure 8A:
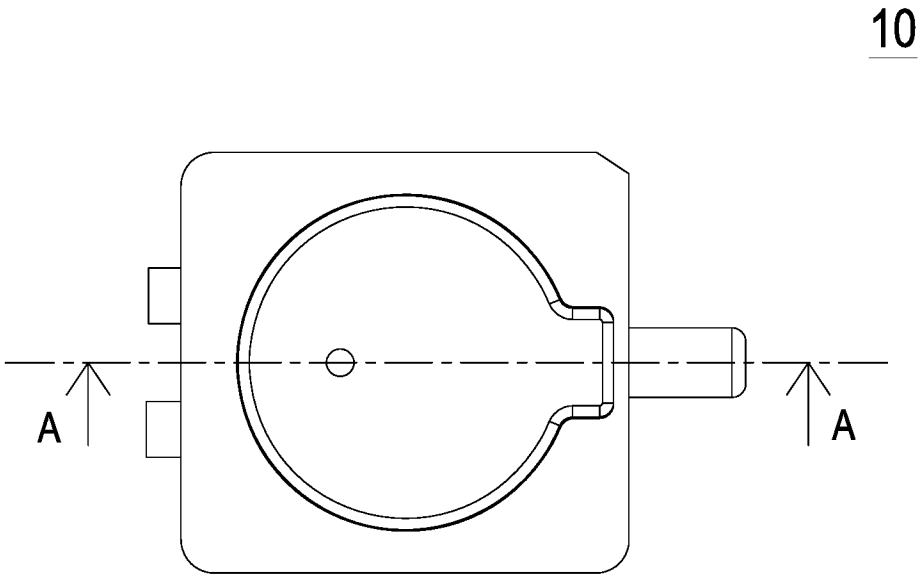
FIG. 8A is a top view illustrating the micro pump of the present disclosure.
Figure 8B:
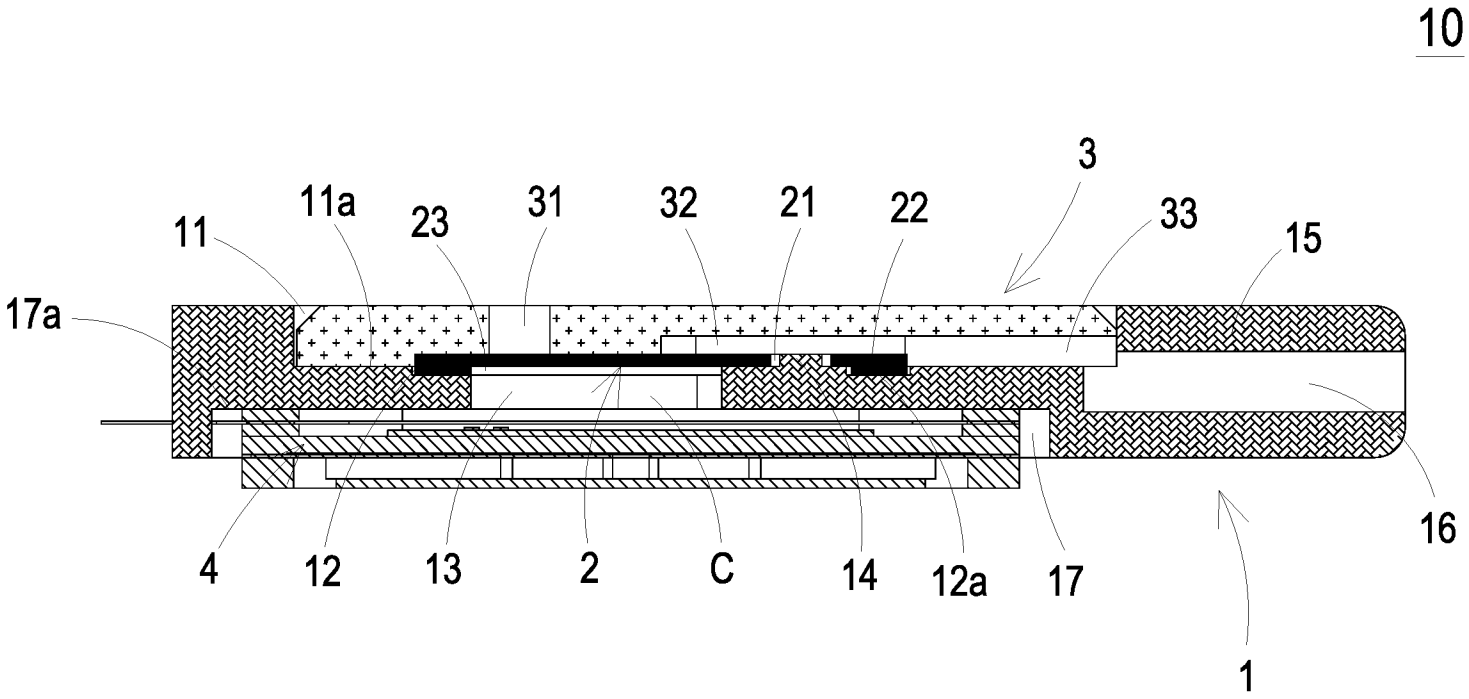
FIG. 8B is a schematic cross-sectional view taken from the line A-A in FIG. 8A.
Figure 8C:
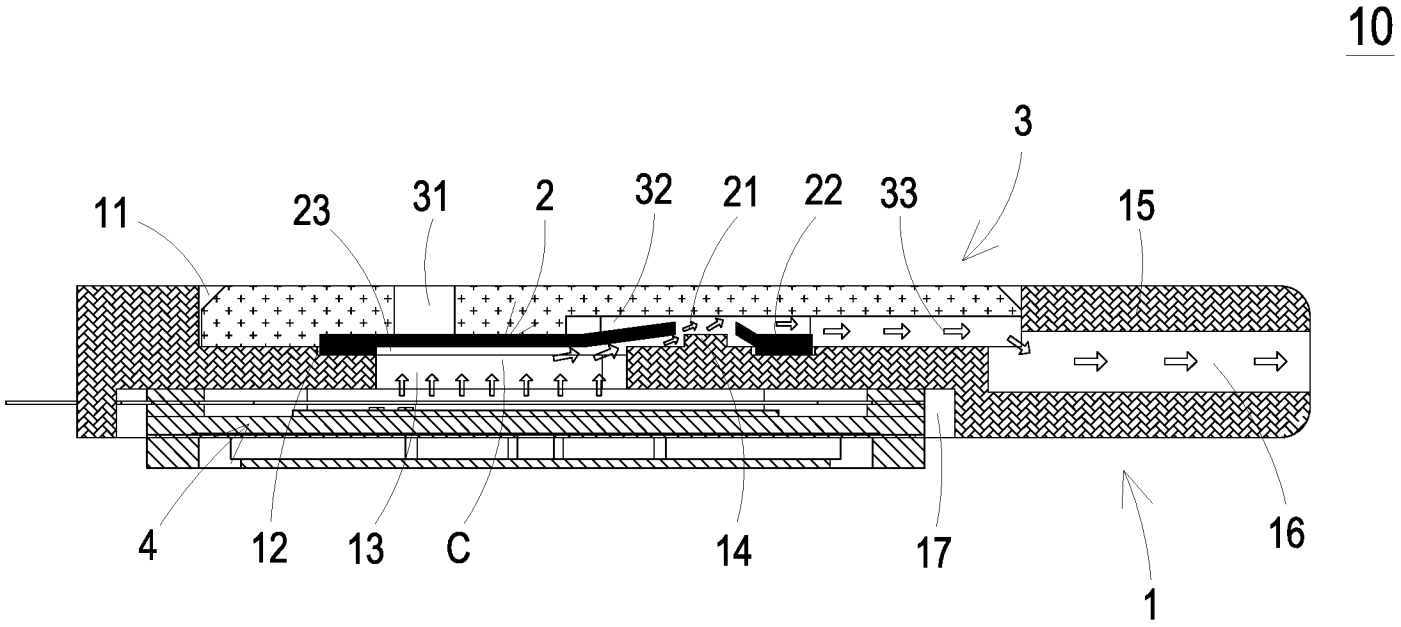
FIG. 8C is a cross sectional view schematically illustrating the fluid discharge action of the micro pump of the present disclosure.
Figure 8D:
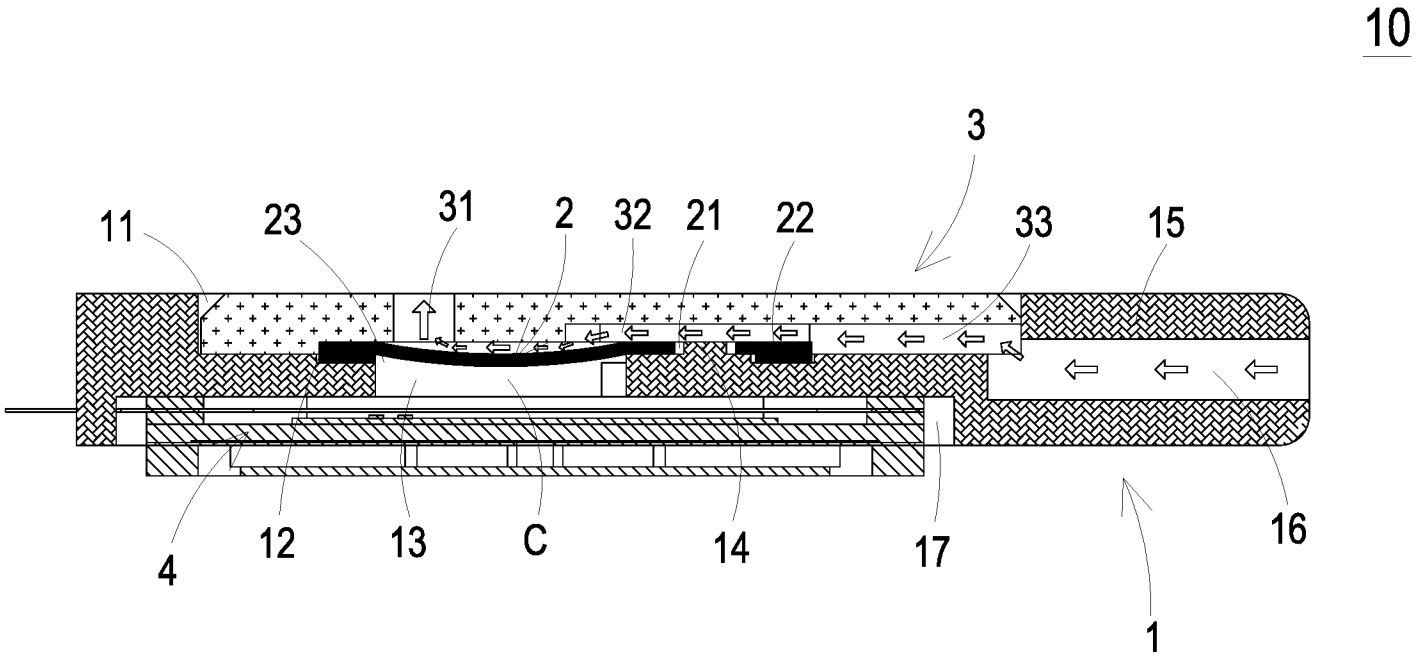
FIG. 8D is a cross sectional view schematically illustrating the fluid relief action of the micro pump of the present disclosure.

Please refer to FIGS. 8A to 8D. In this embodiment, a fluid-converging chamber C is collaboratively defined by the valve space 23 of the valve membrane 2 and the fluid channel 13 of the base plate 1. When the micro pump 10 is actuated and the pump core module 4 is driven, the fluid outside the micro pump 10 is inhaled into the pump core module 4. The fluid passes through the pump core module 4 and flows into the fluid-converging chamber C. Then, the fluid pushes out the valve membrane 2, and the valve aperture 21 of the valve membrane 2 is, therefore, separated from the protruding portion 14 of the base plate 1. The fluid then flows through the valve aperture 21 and enters the fluid converging groove 32 of the upper covering plate 3. Finally, the fluid enters the fluid-outlet channel 16 of the base plate 1 through the fluid converging channel 33 of the upper covering plate 3, and is discharged out from the micro pump 10 through the fluid-outlet channel 16, so as to achieve fluid transportation, as shown in FIG. 8C. When the micro pump 10 is unactuated and the pump core module 4 is not driven, the fluid flows back from the fluid-outlet channel 16 into the micro pump 10, pushes the valve membrane 2 back and makes the protruding portion 14 seal the valve aperture 21 again, and after that the portion of the valve membrane 2 corresponding to the fluid-converging chamber C is pushed away from the upper covering plate 3. As a result, the fluid flows through the space between the valve membrane 2 and the upper covering plate 3, and enters the fluid relief aperture 31, as shown in FIG. 8D. Consequently, the fluid is discharged out of the micro pump 10, so as to achieve fluid relief.

Figure 9:
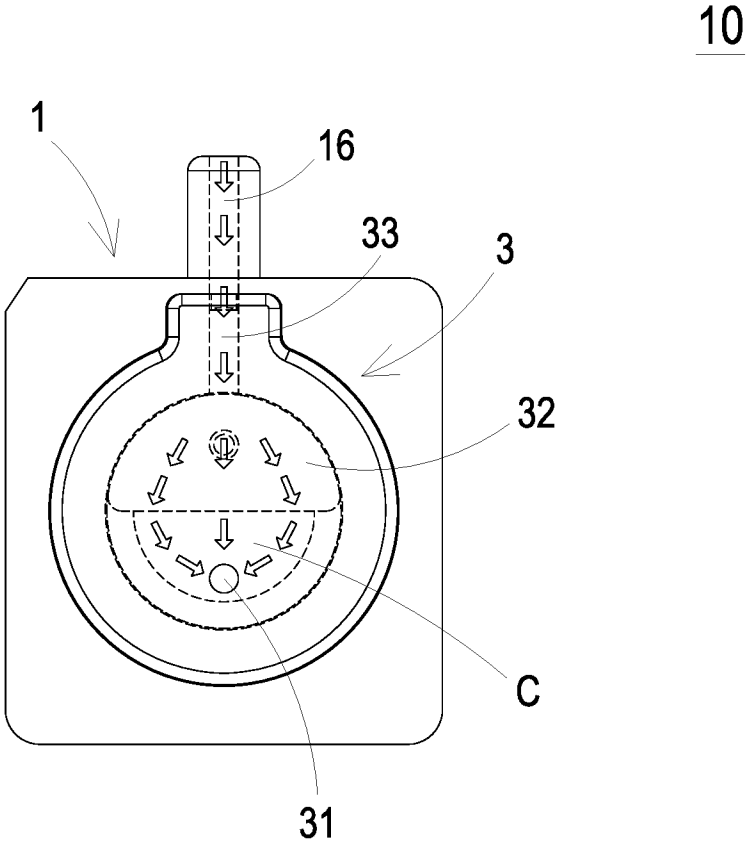
FIG. 9 is a top view illustrating the fluid relief action of the micro pump of the present disclosure.

Please refer to FIG. 9. Notably, in this embodiment, the fluid relief path of the micro pump 10 is from the fluid-outlet channel 16 to the fluid-converging chamber C. Therefore, the cross-section area of the relief path is gradually broader. In addition, since both of the fluid converging groove 32 and the fluid channel 13 have sector profiles and the aperture diameter of the fluid discharging aperture 31 is in the range between 0.5 millimeter (mm) and 2 millimeter (mm), the flow resistance is greatly reduced while the micro pump 10 performs the fluid relief process.

In summary, the present disclosure provides a micro pump. The micro pump is a semi-staggered valve base structure with unidirectional output and pressure relief function. It is beneficial to simplify the structure of the valve membrane greatly, enhance the overall reliability of airtightness, optimize the thin profile of the overall outer case, and reduce the flow resistance of pressure relief greatly. It is extremely valuable for the use of the industry, and it is submitted in accordance with the law.

While the disclosure has been described in terms of what is presently considered to be the most practical and preferred embodiments, it is to be understood that the disclosure needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A micro pump comprising:

a base plate having a first surface and a second surface, wherein the first surface and the second surface are two opposite surfaces, and the base plate comprises:

an upper covering plate accommodation slot recessed from the first surface of the base plate and having a bottom surface;

a valve membrane accommodation slot recessed from the bottom surface of the upper covering plate accommodation slot and having a bottom surface;

a protruding portion protruded from the bottom surface of the upper covering plate accommodation slot;

a pump accommodation slot recessed from the second surface of the base plate and having a bottom surface;

a fluid channel running through the bottom surface of the valve membrane accommodation slot and the bottom surface of the pump accommodation groove; and a fluid-outlet channel;

a valve membrane disposed in the valve membrane accommodation slot of the base plate and comprising a valve aperture, wherein the protruding portion of the base plate is extended through the valve aperture, and the fluid channel of the base plate is sealed by the valve membrane;

an upper covering plate accommodated in the upper covering plate accommodation slot of the base plate and comprising a fluid relief aperture, a fluid converging groove and a fluid converging channel, wherein the fluid relief aperture is sealed by the valve membrane, and the fluid converging groove is in fluid communication with the fluid-outlet channel of the base plate through the fluid converging channel; and a pump core module accommodated within the pump accommodation slot of the base plate, wherein after fluid is inhaled by the pump core module and flows into the pump core module, the fluid passes through the fluid channel of the base plate, pushes out the valve membrane, flows through the valve aperture of the valve membrane, enters the fluid converging groove of the upper covering plate, and is discharged out through the fluid-outlet channel of the base plate, so as to achieve fluid transportation.

2. The micro pump according to claim 1, wherein the fluid channel of the base plate has a sector profile.

3. The micro pump according to claim 1, wherein the valve membrane is a silicone sheet.

4. The micro pump according to claim 1, wherein the base plate further comprises a fluid-output tube extended outwardly from a side of the base plate and penetrated by the fluid-outlet channel.

5. The micro pump according to claim 1, wherein the valve membrane is in a circular shape.

6. The micro pump according to claim 1, wherein the valve membrane has a first surface and a second surface, and the valve aperture runs through the first surface and the second surface, wherein the valve membrane further comprises a valve peripheral wall and a valve space, and the valve peripheral wall is disposed on the second surface and defines the valve space.

7. The micro pump according to claim 1, wherein the fluid relief aperture of the upper covering plate and the protruding portion of the base plate are staggered with each other.

8. The micro pump according to claim 1, wherein the fluid converging groove of the upper covering plate and the fluid channel of the base plate are staggered with each other.

9. The micro pump according to claim 1, wherein the fluid relief aperture of the upper covering plate has an aperture diameter ranging between 0.5 millimeter and 2 millimeter.

10. The micro pump according to claim 1, wherein the fluid converging groove of the upper covering plate has a sector profile.

11. The micro pump according to claim 1, wherein the micro pump has a total thickness ranging between 1 millimeter and 6 millimeter.

12. The micro pump according to claim 1, wherein the pump core module comprises:

a fluid-inlet plate comprising at least one inlet aperture, at least one convergence channel and a convergence chamber, wherein the at least one inlet aperture allows the fluid to flow in and passes through the at least one convergence channel, and the at least one convergence channel and the convergence chamber are in fluid communication, so that the liquid inhaled through the at least inlet aperture is transported through the at least one convergence channel and converged into the convergence chamber;

a resonance plate connected and attached to the fluid-inlet plate and having a central aperture, a movable part and a fixing part, wherein the central aperture is disposed at a center of the resonance plate and aligned with the convergence chamber of the fluid-inlet plate, the movable part surrounds the central aperture, and the fixing part is located at a peripheral portion of the resonance plate and is fixed on and attached to the fluid-inlet plate; and a piezoelectric actuator connected and attached to the resonance plate, wherein a resonance chamber is formed between the resonance plate and the piezoelectric actuator, whereby when the piezoelectric actuator is driven, the movable part of the resonance plate is in resonance with the piezoelectric actuator, and the fluid is introduced into the at least one inlet aperture of the fluid-inlet plate, converged to the convergence chamber along the at least one convergence channel, and flows into the central aperture of the resonance plate, so as to achieve fluid transportation.

13. The micro pump according to claim 12, wherein the piezoelectric actuator comprises:

a suspension plate being a square suspension plate and permitted to undergo a bending vibration;

an outer frame arranged around the suspension plate;

at least one bracket connected between the suspension plate and the outer frame for elastically supporting the suspension plate; and a piezoelectric element, wherein a length of a side of the piezoelectric element is smaller than or equal to a length of a side of the suspension plate, and the piezoelectric element is attached on a surface of the suspension plate to drive the suspension plate to undergo the bending vibration in response to an applied voltage.

14. The micro pump according to claim 13, wherein the pump core module further comprises a conducting plate, the piezoelectric actuator further comprises a first conductive pin extended outwardly from an outer edge of the outer frame, the conducting plate comprises a second conductive pin protruded from an outer edge of the conducting plate, the base plate further comprises a plurality of pin openings in fluid communication with the pump accommodation slot, and the first conducting pin and the second conductive pin are extended outside the base plate through the plurality of pin openings, respectively.

15. The micro pump according to claim 12, wherein the pump core module further comprises a first insulation plate, a conducting plate and a second insulation plate, wherein the fluid-inlet plate, the resonance plate, the piezoelectric actuator, the first insulation plate, the conducting plate and the second insulation plate are stacked sequentially.

16. The micro pump according to claim 12, wherein the piezoelectric actuator comprises:

a suspension plate being a square suspension plate and permitted to undergo a bending vibration;

an outer frame arranged around the suspension plate;

at least one bracket connected between the suspension plate and the outer frame for elastically supporting the suspension plate, wherein a non-coplanar structure is formed on a surface of the suspension plate and a surface of the outer frame to form the resonance chamber between the suspension plate and the resonance plate; and a piezoelectric element, wherein a length of a side of the piezoelectric element is smaller than or equal to a length of a side of the suspension plate, and the piezoelectric element is attached on the surface of the suspension plate to drive the suspension plate to undergo the bending vibration in response to an applied voltage.

* * * * *